US006133226A

United States Patent [19]

Knowlton et al.

[11] Patent Number: 6,133,226

[45] **Date of Patent: *Oct. 17, 2000**

[54] NON-CATIONIC SYSTEMS FOR DRYER SHEETS

[75] Inventors: Charles Nathaniel Knowlton, Glen Rock; Nancy Pergament, Closter; Feng-Lung Gordon Hsu, Tenafly, all of N.J.

[73] Assignee: Lever Brothers Company, division of Conopco, Inc., New York, N.Y.

[ * ] Notice: This patent issued on a continued prosecution application filed under 37 CFR 1.53(d), and is subject to the twenty year patent term provisions of 35 U.S.C. 154(a)(2).

[21] Appl. No.: 08/832,887

[22] Filed: Apr. 4, 1997

Related U.S. Application Data

[63] Continuation-in-part of application No. 08/588,746, Jan. 19, 1996, abandoned.

[51] Int. Cl.[7] ..... C11D 17/04; D06M 13/10

[52] U.S. Cl. ..... 510/520; 252/8.61; 252/8.63; 252/8.81

[58] Field of Search ..... 510/520; 252/8.61, 252/8.63, 8.81

[56] References Cited

U.S. PATENT DOCUMENTS

| | | | |
|---|---|---|---|
| 2,477,383 | 7/1949 | Lewis . | |
| 4,000,077 | 12/1976 | Wixon . | |
| 4,000,340 | 12/1976 | Murphy et al. | 510/519 |
| 4,049,858 | 9/1977 | Murphy | 510/520 |
| 4,057,673 | 11/1977 | Falivene | 510/520 |
| 4,082,678 | 4/1978 | Pracht et al. . | |
| 4,094,797 | 6/1978 | Newkirk et al. . | |
| 4,096,071 | 6/1978 | Murphy | 510/520 |
| 4,103,047 | 7/1978 | Zaki et al. | 510/520 |
| 4,110,227 | 8/1978 | Newkirk et al. . | |
| 4,127,694 | 11/1978 | Murphy et al. | 510/519 |
| 4,134,838 | 1/1979 | Hooper et al. . | |
| 4,137,180 | 1/1979 | Naiket et al. . | |
| 4,137,181 | 1/1979 | Hawkins . | |
| 4,142,978 | 3/1979 | Murphy | 510/519 |
| 4,170,678 | 10/1979 | Urfer et al. | 510/520 |
| 4,179,543 | 12/1979 | Hawkins . | |
| 4,199,647 | 4/1980 | Newkirk et al. . | |
| 4,209,549 | 6/1980 | Murphy et al. | 510/520 |
| 4,238,531 | 12/1980 | Rudy et al. . | |
| 4,288,331 | 9/1981 | Shepley et al. . | |
| 4,294,883 | 10/1981 | Hawkins . | |
| 4,327,133 | 4/1982 | Rudy et al. . | |
| 4,397,754 | 8/1983 | Collishaw et al. . | |
| 4,408,995 | 10/1983 | Guth et al. . | |
| 4,413,998 | 11/1983 | Guth et al. . | |
| 4,421,792 | 12/1983 | Rudy et al. . | |
| 4,497,716 | 2/1985 | Tai . | |
| 4,501,589 | 2/1985 | Oschatz . | |
| 4,525,170 | 6/1985 | Balliello . | |
| 4,532,719 | 8/1985 | Davies et al. . | |
| 4,565,647 | 1/1986 | Lienado . | |
| 4,622,038 | 11/1986 | Login et al. . | |
| 4,721,580 | 1/1988 | Gooselink . | |
| 4,756,850 | 7/1988 | Nayar . | |
| 4,764,289 | 8/1988 | Trinh . | |
| 4,808,086 | 2/1989 | Evans et al. . | |
| 4,818,422 | 4/1989 | Adams et al. | 510/297 |
| 4,818,569 | 4/1989 | Trinh et al. . | |
| 4,824,582 | 4/1989 | Nayar | 510/520 |
| 4,826,632 | 5/1989 | Blackbum et al. . | |
| 4,849,257 | 7/1989 | Borcher, Sr. et al. . | |
| 4,883,604 | 11/1989 | Veitenhansl et al. . | |
| 4,889,644 | 12/1989 | Amberg et al. . | |
| 4,913,828 | 4/1990 | Caswell et al. . | |
| 4,913,829 | 4/1990 | Rutzen et al. . | |
| 4,923,636 | 5/1990 | Blackbum et al. . | |
| 4,925,577 | 5/1990 | Borcher, Sr. et al. . | |
| 4,929,366 | 5/1990 | Yamamoto et al. . | |
| 4,929,367 | 5/1990 | Thomas et al. . | |
| 4,971,706 | 11/1990 | Wixon . | |
| 4,973,422 | 11/1990 | Schmidt . | |
| 4,976,741 | 12/1990 | Hisamoto et al. . | |
| 5,000,978 | 3/1991 | Davidson et al. . | |
| 5,009,668 | 4/1991 | Berendt et al. . | |
| 5,041,230 | 8/1991 | Borcher et al. . | |
| 5,047,165 | 9/1991 | Lysy et al. . | |
| 5,062,973 | 11/1991 | Kellett . | |
| 5,066,413 | 11/1991 | Kellett . | |
| 5,082,578 | 1/1992 | Langer et al. . | |
| 5,128,055 | 7/1992 | Foster . | |
| 5,145,595 | 9/1992 | Morris et al. | 510/520 |
| 5,152,802 | 10/1992 | Berger et al. . | |
| 5,202,045 | 4/1993 | Karpusiewicz et al. . | |
| 5,207,802 | 5/1993 | Baumann . | |
| 5,208,074 | 5/1993 | Kosal . | |
| 5,238,587 | 8/1993 | Smith et al. . | |
| 5,269,950 | 12/1993 | Iwamoto et al. . | |
| 5,270,113 | 12/1993 | Rebouillat . | |
| 5,273,684 | 12/1993 | Traber et al. . | |
| 5,308,512 | 5/1994 | Stoll et al. . | |
| 5,324,455 | 6/1994 | Dumas et al. . | |
| 5,350,529 | 9/1994 | Day . | |
| 5,376,287 | 12/1994 | Borcher, Sr. et al. . | |
| 5,399,271 | 3/1995 | Puchta et al. | 510/519 |
| 5,419,842 | 5/1995 | Crutzen . | |
| 5,484,553 | 1/1996 | Guth et al. . | |
| 5,503,756 | 4/1996 | Corona III, et al. . | |

FOREIGN PATENT DOCUMENTS

| | | |
|---|---|---|
| 0194813 | 9/1986 | European Pat. Off. . |
| 1482782 | 8/1977 | United Kingdom . |
| 92/06174 | 4/1992 | WIPO . |
| 97/26316 | 7/1997 | WIPO . |

*Primary Examiner*—Lorna M. Douyon
*Attorney, Agent, or Firm*—Neil Y. Gilbert, Esq.

[57] ABSTRACT

Tumble dryer articles having a fabric conditioning composition providing anti-static softening, stain removal, stain guard and anti-active build-up benefits in an automatic clothes dryer are described. The composition comprises 3 to 80 wt. % of a nonionic surfactant having an HLB value of greater than 11, 3 to 50 wt. % of an anionic surfactant, 0 to 80 wt. % of a non-surfactant release aid and up to 25 wt. % of an aqueous ingredient provided the total amount of the nonionic and anionic surfactant is 20 wt. % or more and the ratio of the aqueous ingredient to the anionic surfactant is less than 2:1.

9 Claims, No Drawings

NON-CATIONIC SYSTEMS FOR DRYER SHEETS

RELATED APPLICATION

This application is a continuation-in-part of U.S. Ser. No. 08/588,746 filed on Jan. 19, 1996 now abandoned.

FIELD OF THE INVENTION

This invention pertains to fabric conditioning compositions which provide primarily both anti-static and softening benefits to fabrics tumble dried in an automatic clothes dryer, and a process for producing such compositions. Stain guard benefits, stain removal and anti-active build-up benefits are also obtained with these compositions.

BACKGROUND OF THE INVENTION

The present invention relates to compositions which may be applied to articles of manufacture to provide anti-static and softening benefits to fabrics dried in an automatic clothes dryer. More specifically, the present invention relates to a non-cationic conditioning composition which provides effective anti-static control through a drying cycle period and articles made therefrom which exhibit good storage stability.

Cationic anti-static conditioning compounds and compositions designed for application to fabrics in an automatic dryer are well known in the art. The majority of the commercially available tumble dryer articles contain one or a multiple of cationic surfactants. A few non-cationic containing compounds have been incorporated into fabric compositions in an attempt to improve biodegradability and commercial production.

For example, U.S. Pat. No. 4,209,549 discloses a highly ethoxylated nonionic as an anti-static agent which is preferably admixed with mixtures of glycerides and glyceride-fatty alcohol to provide a fabric softening aspect to the composition. The ethoxylated nonionic disclosed in this patent has at least 20 ethoxy groups per molecule. This composition has shown either poor antistatic efficacy during the drying cycle or poor storage properties, or both.

U.S. Pat. No. 5,145,595 discloses an anti-static softening composition for use in automatic clothes dryers comprising an ethoxylated alcohol, a fatty alcohol and a stabilizer which is a particulate solid and prevents any substantial release of the ethoxylated alcohol-fatty alcohol mixture. Again, the ethoxylated alcohol has at least 20 ethoxy groups per molecule. Furthermore, the particulate stabilizer adversely effects the process of coating the composition onto a dryer article.

GB 1,482,782 discloses fabric conditioning compositions that impart softening and crispness to the fabric. The compositions contain an oil-soluble nonionic surfactant having an HLB of less than 11 and a crisping component insoluble in water that may be a fatty alcohol, a fatty acid, or an insoluble (calcium or magnesium) soap of a fatty acid. The composition may be dispensed from a hollow sponge, a bag or a sheet substrate, or manually scattered, in a granular form, onto the fabric before the start of the drying cycle. The insoluble calcium or magnesium soap of a fatty acid can build up as an undesirable residue on treated fabrics. The oil-soluble nonionic surfactant is being used for softening and not for antistatic protection. The use of a nonionic surfactant with an HLB of less than 11 provides ineffective antistatic control.

U.S. Pat. 5,399,271 discloses a fabric conditioning composition for automatic clothes dryers containing a fatty component which comprises a) fatty acid mono-, di-, and tri-glycerides and-or fatty acids and-or fatty alcohols in admixture with b) fatty alcohol alkoxylates and-or fatty acid esters of monohydric alcohols. The compositions of fatty acids or fatty alcohols and alcohol alkoxylates suffer the similar deficiency shown by the compositions taught in U.S. Pat. No. 4,209,549, in that the compositions are ineffective anti-static controls throughout the drying cycle and have poor storage properties.

U.S. Pat. No. 5,376,287 discloses dryer-activated fabric softening compositions and articles for use in an automatic clothes dryer which comprise (a) a highly ethoxylated sugar derivative and (b) a carboxylic acid salt of tertiary amine. The free amine residue produced from processing the carboxylic acid salt of tertiary amine can result in odor problems and provide poorer softening performance.

It has now surprisingly been found that anionic surfactants, which are individually unsuitable as antistatic fabric softeners, can be combined with selected nonionic surfactants (likewise poor and antistatic agents when used alone in the drying cycle), to form mixtures capable of providing an excellent antistatic efficacy throughout the entire drying cycle while also exhibiting good storage stability.

SUMMARY OF THE INVENTION

The present invention relates to tumble dryer articles having a fabric conditioning composition providing both anti-static and softening benefits in an automatic clothes dryer. The composition comprises 3 to 80 wt. % of a nonionic surfactant exhibiting an HLB value of greater than 11, 3 to 50 wt. % of an anionic surfactant, 0 to 80 wt. % of a non-surfactant release aid and up to 25 wt. % of an aqueous ingredient provided the total amount of the nonionic and anionic surfactant is 20 wt. % or more and the ratio of the aqueous ingredient to the anionic surfactant is less than 2:1.

DETAILED DESCRIPTION OF PREFERRED EMBODIMENTS

The compositions of the invention are composed of selected detergent raw materials which when combined provide improved tumble dryer articles. Specially selected ratios of particular anionic surfactants conventionally used in fabric conditioning, nonionic surfactants, non-surfactant release aids and optional ingredients are combined to form dryer articles with good anti-static and storage properties.

(A) Anionic Surfactant

The compositions of the invention contain an anionic surfactant in an amount of from about 3 to 50 wt. %, preferably 4 to 35%, most preferably 5 to 25 wt. %.

The following anionic surfactants are useful in the present composition.

i) Water-soluble salts of the higher fatty acids, i.e., "soaps", are useful anionic surfactants in the compositions herein. These include alkali metal soaps such as the sodium, potassium, ammonium, and alkylolammonium salts of higher fatty acids containing from about 8 to about 24 carbon atoms, and preferably from about 12 to about 18 carbon atoms. Soaps can be made by direct saponification of fats and oils or by the neutralization of free fatty acids. Particularly useful are the sodium and potassium salts of the mixtures of free fatty acids derived from coconut oil and tallow, i.e., sodium or potassium tallowate and sodium or potassium cocoate. Especially preferred is the potassium salt.

ii) Useful anionic surfactants also include the water-soluble salts, preferably the alkali metal, ammonium and alkylolammonium salts, of organic sulfuric reaction products having in their molecular structure an alkyl group containing from about 10 to about 20 carbon atoms and a sulfonic acid or sulfuric acid ester group. (Included in the term "alkyl" is the alkyl portion of acyl groups.) Examples of this group of synthetic surfactants are the sodium and potassium alkyl sulfates, especially those obtained by sulfating the higher alcohols (C8–C18 carbon atoms) such as those product by reducing the glycerides of tallow or coconut oil; and the sodium and potassium alkyl benzene sulfonates in which the alkyl group contains from about 9 to about 15 carbon atoms, in straight chain or branched chain configuration. Examples of such synthetic surfactants are described in U.S. Pat. Nos. 2,220,099 and 2,477,383. Especially preferred surfactants are linear straight chain alkyl benzene sulfonates in which the average number of carbon atoms in the alkyl group is from about9 to 14, i.e., $C_{9-14}$ LAS).

iii) Other anionic surfactants useful herein are the sodium alkyl glyceryl ether sulfonates, especially those ethers of higher alcohols derived from tallow and coconut oil; sodium coconut oil fatty acid monoglyceride sulfonates and sulfates; sodium or potassium salts of alkyl phenol ethylene oxide ether sulfates containing from about 1 to about 10 units of ethylene oxide per molecule and wherein the alkyl groups contain from about 8 to about 12 carbon atoms; and sodium or potassium salts of alkyl ethylene oxide ether sulfates containing about 1 to about 10 units of ethylene oxide per molecule and wherein the alkyl group contains from about 10 to about 20 carbon atoms.

iv) Other useful anionic surfactants herein include the water-soluble salts of esters of alpha-sulfonated fatty acids containing from about 6 to 20 carbon atoms in the fatty acid group and from about 1 to 10 carbon atoms in the ester group; water-soluble salts of 2-acyloxy-alkane-1-sulfonic acids containing from about 2 to 9 carbon atoms in the acyl group and from about 9 to about 23 carbon atoms in the alkane moiety; alkyl ether sulfates containing from about 10 to 20 carbon atoms in the alkyl group and from about 1 to 30 moles of ethylene oxide; water-soluble salts of olefin sulfonates containing from about 12 to 24 carbon atoms; and beta-alkyloxy alkane sulfonates containing from about 1 to 3 carbon atoms in the alkyl group and from about 8 to 20 carbon atoms in the alkane moiety.

v) Additional anionic surfactants which are suitable for the present invention are described in McCutcheons "Detergents and Emulsifiers" North American Edition, 1994 Annual, incorporated herein by reference.

(B) Nonionic Surfactant

The water-soluble nonionic surfactant must be present in the inventive compositions in an amount of 3 to 80 wt. %, preferably 10 to 70 wt. %, most preferably 30 to 60 wt. %, and the combination of the anionic and water-soluble nonionic surfactant must be greater than or equal to 20 wt. %.

While water-soluble nonionic and anionic surfactants individually are unsuitable as antistatic agents in the tumble dryer, when combined as described in this invention, they provide effective antistatic control through the drying cycle period. While not intending to be limited by theory, it appears that water-soluble nonionic surfactants are effective antistatic controls because of their hydrophilic character which can associate with water present in the tumble dryer and dissipate charge in this manner. Although in theory, an ionic surfactant should be a better antistatic agent than a nonionic surfactant, ionic surfactants have high melting points which impedes transfer to fabric.

In the present invention, water-soluble nonionic surfactants having an HLB greater than 11 are employed because of their strong hydrophilic character which is thought to help in the dissipation of charge and dispersing the anionic surfactant throughout the fabrics at dryer operating temperature.

Nonionic synthetic detergents may be broadly defined as compounds produced by the condensation of alkylene oxide groups (hydrophilic in nature) with an organic hydrophobic compound, which may be aliphatic or alkyl aromatic in nature. The length of the hydrophilic or polyoxyalkylene radical which is condensed with any particular hydrophobic group can be readily adjusted to yield a water-soluble compound having the desired degree of balance between hydrophilic and hydrophobic elements. Suitable nonionic detergent surfactants are generally disclosed in U.S. Pat. No. 3,939,678, Laughlin et al., issued Dec. 30, 1975, at column 13, line 14, through column 16, line 6, incorporated herein by reference. The water-soluble nonionic surfactants useful herein have a hydrophilic-lipophilic balance (HLB) of greater than 11, preferably 11.5–20, most preferably greater than 12 to 17. The HLB's of the selected nonionic surfactants useful in the invention can be calculated in the manner set forth in Becker, "Emulsions Theory and Practice", Reinhold 1965, pp. 233–248.

For example, for the linear alcohol ethoxylates which are a preferred class of surfactants herein, the equation $$HLB=E/5$$

where E is the weight percentage of oxyethylene content, can be used to calculate the HLB's.

Preferred nonionic surfactants are:

i) The condensation products of aliphatic alcohols with from about 3 to about 30 moles of ethylene oxide. The alkyl chain of the aliphatic alcohol can either be straight or branched, primary or secondary, and generally contains from about 8 to about 22 carbon atoms. Particularly preferred are the condensation products of alcohols having an alkyl group containing from about 10 to about 20 carbon atoms with from about 5 to about 20 moles of ethylene oxide per mole of alcohol more preferably 7 to 15. Examples of such ethoxylated alcohols include the condensation product of coconut alcohol with about 9 moles of ethylene oxide per mole of alcohol; and the condensation product of stearyl alcohol with about 20 moles of ethylene oxide. Examples of commercially available nonionic surfactants of this type include Neodol 25-9 (the condensation product of C12–C15 linear alcohol with 9 moles of ethylene oxide, HLB 13.1), supplied by Shell Chemical Company; Hetoxol STA-20 (the condensation product of C16–C18 linear alcohol with 20 moles of ethylene oxide, HLB 15.3), marketed by Heterene Inc.; Alfonic 141 2-60 (the condensation product of C14–C15 w/11 moles EO), marketed by Vista; Neodol 45-13 (the condensation product of C14–C15 linear alcohol with 13 moles of ethylene oxide, HLB 14.5); and Neodol 25-12 (the condensation product of C12–C15 linear alcohol with 12 moles of ethylene oxide, HLB 14.4), marketed by Shell Chemical Company.

Other nonionic surfactants which may be useful include:

ii) The polyethylene oxide condensates of alkyl phenols. These compounds include the condensation products of alkyl phenols having an alkyl group containing from about 6 to about 12 carbon atoms in either a straight chain or branched chain configuration with ethylene oxide, the ethylene oxide being present in an amount equal to from about 5 to about 25 moles of ethylene oxide per mole of alkyl phenol.

iii) The condensation products of ethylene oxide with a hydrophobic base formed by the condensation of propylene oxide with propylene glycol.

iv) The condensation products of ethylene oxide with the products resulting from the reaction of propylene oxide and ethylenediamine.

v) Semi-polar nonionic surfactants which include water-soluble amine oxides containing one alkyl moiety of from about 10 to about 18 carbon atoms and 2 moieties selected from the group consisting of alkyl groups and hydroxyalkyl groups containing from about 1 to about 3 carbon atoms; water-soluble phosphine oxides containing one alkyl moiety of from about 10 to about 18 carbon atoms and 2 moieties selected from the groups consisting of alkyl groups and hydroxyalkyl groups containing from about 1 to about 3 carbon atoms; and water-soluble sulfoxides containing one alkyl moiety of from about 10 to about 18 carbon atoms and a moiety selected from the groups consisting of alkyl and hydroxyalkyl moieties of from about 1 to about 3 carbon atoms.

vi) Alkylpolysaccharides disclosed in U.S. Pat. No. 4,565,647, Llenado, issued Jan. 21, 1986, having a hydrophobic group containing from about 6 to about 30 carbon atoms, preferably from about 10 to about 16 carbon atoms and a polysaccharide, e.g., a polyglycoside, hydrophilic group containing from about 1.3 to about 2.7 saccharide units are also useful. Such polysaccharides are disclosed in U.S. Pat. No. 4,565,647, Llenado, issued Jan. 21, 1986.

vii) Fatty acid amide surfactants having the formula:

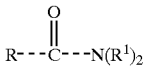

wherein R is an alkyl group containing from about 7 to about 21 (preferably from about 9 to about 17) carbon atoms and each $R^1$ is selected from the group consisting of hydrogen, $C_1$–$C_4$ hydroxyalkyl, and —$(C_2H_4O)/_xH$ where x is from about 1 to about 3.

viii) Other suitable nonionic surfactants useful for the compositions described herein are described in McCutcheon's "Detergents and Emulsifiers" North American Edition, 1994 Annual, incorporated herein by reference.

(C) Optional Non-surfactant Release Aid

The anionic surfactants and nonionic surfactants described herein are preferably formulated in combination with mixtures of lipophilic non-surfactant components which are solid or semi-solid at temperatures below about 350° C. but which soften and flow at automatic dryer temperatures, i.e., 50° C. to 100° C. These are called "non-surfactants release aids" for the purposes of the present invention because they are not conventionally used as detergents or emulsifiers as found, for example, in McCutcheon's "Detergents and Emulsifiers" North American Edition, 1994 Annual. The non-surfactant release aids are used in the compositions in an amount of 0 to 80 wt. %, more preferably 25 to 75 wt %.

Suitable examples of non-surfactant release aids useful for the invention include but are not limited to:

i) Carboxylic acids having 8 to 30 carbon atoms and one carboxylic group per molecule. The alkyl portion has 8 to 30, preferably 12 to 22 carbon atoms. The alkyl portion may be linear or branched, saturated or unsaturated, with linear saturated alkyl preferred. Stearic acid is a preferred fatty acid for use in the composition herein. Useful carboxylic acids of stearic acid, which contains from about 30 to about 60 percent palmitic acid and from about 40 to about 70% stearic acid. A commercial example is supplied under the Emersol® series by Henkel.

ii) Fatty acid esters of, e.g., hydroxy, including polyhydroxy, alcohols, including glycerine, etc., and/or fatty alcohol esters of carboxylic acids. Useful glycerol and polyglycerol esters include mono-esters with stearic, oleic, palmitic, lauric, isostearic, myristic, and/or behenic acids and the diesters of stearic, oleic, palmitic, lauric, isostearic, behenic, and/or myristic acids. It is understood that the typical mono-ester contains some di- and tri-ester, etc. Fatty acid esters of monohydric alcohols are also understood to include fatty acid ester mixtures of different composition, including for example the carnauba wax obtainable from the leaves of the Brazilian fa palm Copernica prunivera, the candelilla wax obtained from the leaves of Euphorbiacease, jojoba oil and natural or synthetic beeswax.

iii) Fatty alcohols having about 8 to about 22 or having 10 to 20 carbon atoms per molecule. The alkyl portion may be linear or branched, saturated or unsaturated, with linear saturated alkyl preferred. Especially preferred alcohols herein fall within the tallowalkyl range. A commercial example of a preferred fatty alcohol is Hydrenol D (linear saturated $C_{16}$–$C_{18}$ alcohols), supplied by Henkel Corp.

iv) Glyceride mixtures, including mono-, di- and tri-glycerides and mixtures thereof. Glyceride mixtures of the type useful herein can be more conveniently prepared from natural or synthetic triglycerides by means of a trans-esterification reaction employing glycerine and a base. Such trans-esterification reactions take place in processes well-known in the art to provide random mixtures of mono-, di- and tri-glycerides. Preferred precursor materials for the glyceride mixtures herein include lard, winterized lard, tallow, hydrogenated (hardened) tallow, hydrogenated (hardened) soybean oil, and hydrogenated (hardened) peanut oil. Any of these materials can be trans-esterified in the presence of glycerine and base in processes conventionally used in the art to provide the glyceride mixtures useful herein.

v) Synthetic waxes such as paraffin wax are also useful. A paraffin wax is a petroleum wax consisting principally of normal alkanes. Paraffin, microcrystalline, and semicrystalline waxes may be differentiated using the refractive index of the wax and its congealing point as determined by ASTM D938 (36). Semimicrocrystalline and microcrystalline waxes are petroleum waxes containing substantial proportions of hydrocarbons other than normal alkanes. Paraffin wax is macrocrystalline, brittle, and it is composed of 40–90 wt. % normal paraffins and the remainder is $C_{18}$–$C_{36}$ isoalkanes and cycloalkanes.

vi) $C_2$–$C_4$ alkylene oxide condensation products having an average molecular weight of about 400 to about 5, 000. The alkylene oxide condensation product can be represented by homopolymeric condensation products as well as by copolymers of alkylene oxide monomers with different carbon chain lengths. The monomers can include ethylene oxide, propylene oxide and butylene oxide. Suitable for use in the compositions of this invention are copolymers of ethylene and propylene oxides in varying molecular ratios. A commercial example of a suitable alkylene oxide condensation product useful in the present invention is Pluracol ex BASF which is a homopolymer of ethylene oxide having an average molecular weight of 4,000.

(D) Optionals Ingredients

In a preferred embodiment, water or water-soluble materials in the amount of from 0 to 25% are present. Water is the most preferred optional ingredient. Water is a natural by-product of the neutralization reaction that forms the anionic surfactant. It has been found that higher amounts of water (up to about 25 wt. %) can be incorporated into the formula without problems, and this inclusion is commercially useful.

Other optional ingredients useful in the present invention include polyhydric alcohols having from 1 to about 6 carbon atoms, such as propylene glycol, glycerin or sorbitol.

If such an optional ingredient is included in the inventive compositions the ratio of the water or water soluble material to the anionic surfactant must be less than 2:1.

(E) Optional Additives

Additives which may be optionally included in fabric conditioning compositions of the present invention in their conventional levels include optical brighteners or fluorescent agents, antioxidants, colorants dyes, pigments, opacifiers, germicides, perfumes, bacteriocides, enzymes, dye transfer inhibitors, soil release polymers, skin care benefit agents, perfume carriers (e.g starch, cyclodextrins) and the like. The general level of use of any such ingredient is 0 to about 10%; preferable 0.1 to 5 wt. %.

(F) Preparation of Antistatic Fabric Softening Compositions

The present antistatic, fabric softening compositions may be formed by combining pre-determined amounts of pre-neutralized anionic surfactants, nonionic surfactants, optional non-surfactant release aids and optional ingredients under suitable conditions of agitation and temperature control, eg., at 60°–185° F. The optional ingredients, eg., water, may be added to make up any evaporation loss.

The preferred method of making the compositions is to neutralize the selected anionic acids in the presence of selected nonionic surfactants and/or the optional non-surfactant release aids and/or optional ingredients, and subsequently, mixing in the rest of the ingredients.

A second method of preparing the formulation is by neutralizing the anionic acids in the presence of the optional non-surfactant release aids and-or optional ingredients, then mixing in the nonionic surfactants and optional ingredients. The most preferred method is by first neutralizing the anionic acids in the presence of nonionic surfactants at 135°–185° F., then mixing in any optional non-surfactant release aids at 170°–185° F.; forming a homogeneous mixture, and finally adding the rest of the optional ingredients.

The final product is a transparent isotropic liquid having a viscosity of less than 1,000 cps at 180° F., preferably less than 200 cps at 180° F.

(G) Tumble Dryer Article

In the preferred embodiment, the conditioning composition of the present invention may be coated onto a flexible substrate which carries a fabric conditioning amount of the composition and is capable of releasing the composition at dryer operating temperature. The conditioning composition in turn has a preferred melting (or softening) point of about 25° C. to about 150° C.

The fabric conditioning composition which may be employed in the invention is coated onto a dispensing means which effectively releases the fabric conditioning composition in a tumble dryer. Such dispensing means can be designed for single usage or for multiple uses. One such multi-use article comprises a sponge material releasable enclosing enough of the conditioning composition to effectively impart fabric softness during several drying cycles. This multi-use article can be made by filling a porous sponge with the composition. In use, the composition melts and leaches out through the pores of the sponge to soften and condition fabrics. Such a filled sponge can be used to treat several loads of fabrics in conventional dryers, and has the advantage that it can remain in the dryer after use and is not likely to be misplaced or lost.

Another article comprises a cloth or paper bag releasable enclosing the composition and sealed with a hardened plug of the mixture. The action and heat of the dryer opens the bag and releases the composition to perform its softening.

A highly preferred article comprises the inventive compositions releasably affixed to a flexible substrate such as a sheet of paper or woven or non-woven cloth substrate. When such an article is placed in an automatic laundry dryer, the heat, moisture, distribution forces and tumbling action of the dryer removes the composition from the substrate and deposits it on the fabrics.

The sheet conformation has several advantages. For example, effective amounts of the compositions for use in conventional dryers can be easily absorbed onto and into the sheet substrate by a simple dipping or padding process. Thus, the end user need not measure the amount of the composition necessary to obtain fabric softness and other benefits. Additionally, the flat configuration of the sheet provides a large surface area which results in efficient release and distribution of the materials onto fabrics by the tumbling action of the dryer.

The substrates used in the articles can have a dense, or more preferably, open or porous structure. Examples of suitable materials which can be used as substrates herein include paper, woven cloth, and non-woven cloth. The term "cloth" herein means a woven or non-woven substrate for the articles of manufacture, as distinguished from the term "fabric" which encompasses the clothing fabrics being dried in an automatic dryer.

It is known that most substances are able to absorb a liquid substance to some degree; however, the term "absorbent" as used herein, is intended to mean a substrate with an absorbent capacity (i.e., a parameter representing a substrate's ability to take up and retain a liquid) from 4 to 12, preferably 5 to 7 times its weight of water.

If the substrate is a foamed plastics material, the absorbent capacity is preferably in the range of 15 to 22, but some special foams can have an absorbent capacity in the range from 4 to 12.

Determination of absorbent capacity values is made by using the capacity testing procedures described in U.S. Federal Specifications (UU-T-595b), modified as follows:

1. tap water is used instead of distilled water
2. the specimen is immersed for 30 seconds instead of 3 minutes;
3. draining time is 15 seconds instead of 1 minutes; and
4. the specimen is immediately weighed on a torsion balance having a pan with turned-up edges.

Absorbent capacity values are then calculated in accordance with the formula given in said Specification. Based on this test, one-ply, dense bleached paper (e.g., Kraft or bond having a basis weight of about 32 pounds per 3,000 square feet) has an absorbent capacity of 3.5 to 4; commercially available household one-ply towel paper has a value of 5 to 6; and commercially available two-ply household toweling paper has a value of 7 to about 9.5.

Suitable materials which can be used as a substrate in the invention herein include, among others, sponges, paper, and woven and non-woven cloth, all having the necessary absorbency requirements defined above.

The preferred non-woven cloth substrates can generally be defined as adhesively bonded fibrous or filamentous products having a web or carded fiber structure (where the fiber strength is suitable to allow carding), or comprising fibrous mats in which the fibers or filaments are distributed haphazardly or in random array (i.e., an array of fibers in a carded web wherein partial orientation of the fibers is frequently present, as well as a completely haphazard distributional orientation), or substantially aligned. The fibers or filaments can be natural (e.g., wool, silk, jute, hemp, cotton, lene, sisal, or ramie) or synthetic (e.g., rayon, cellulose ester, polyvinyl derivative, polyolefins, polyamides, or polyesters).

The preferred absorbent properties are particularly easy to obtain with non-woven cloths and are provided merely by building up the thickness of the cloth, i.e., by superimposing a plurality of carded webs or mats to a thickness adequate to obtain the necessary absorbent properties, or by allowing a sufficient thickness of the fibers to deposit on the screen. Any diameter or denier of the fiber (generally up to about 10 denier) can be used, inasmuch as it is the free space between each fiber that makes the thickness of the cloth directly related to the absorbent capacity of the cloth, and which, further, makes the non-woven cloth especially suitable for impregnation with a composition by means of intersectional or capillary action. Thus, any thickness necessary to obtain the required absorbent capacity can be used.

When the substrate for the composition is a non-woven cloth made from fibers deposited haphazardly or in random array on the screen, the articles exhibit excellent strength in all directions and are not prone to tear or separate when used in the automatic clothes dryer.

In applying the fabric conditioning composition to the absorbent substrate, the amount impregnated into and/or coated onto the absorbent substrate is conveniently in the weight ratio range of from about 10:1 to 0.5:1 based on the ratio of total conditioning composition to dry, untreated substrate (fiber plus binder). Preferably, the amount of the conditioning composition ranges from about 5:1 to about 1:1, most preferably from about 3:1 to 1:1, by weight of the dry, untreated substrate.

(H) Method of Use

The articles of manufacture of the present invention can be used for imparting the above-described fabric treatment composition to fabric to provide anti-static and/or softening effects to fabric in an automatic laundry dryer. Generally, the method of using the composition of the present invention is commingled with pieces of damp fabric by tumbling the fabrics under heat in an automatic clothes dryer with an effective amount of the fabric treatment composition.

EXAMPLES

The following examples illustrate without limitation the present invention.

Example 1

Preparation of Conditioning Composition

Several conditioning compositions of the present invention were prepared according to the following procedure.

Formulations in 1000 gram batches and containing various wt. % of water (v), potassium stearate (x), a nonionic surfactant (v), and stearic acid (z) were prepared.

A typical formulation of those prepared would be:

a) stearic acid (average molecular weight of 270 g/mole), g A=10 * x * 270/308.1 b) 45 w/w % potassium hydroxide solution, g B=10 * x *124.7/308.1 c) nonionic surfactant supplied as Neodol 25-9 (HLB 13.1), g C=10* y d) stearic acid (average molecular weight of 270 g/mole), g D=10* z e) water, g E=1000−A−B−C−D (f) x+y+z+v=100

The nonionic surfactant (part C) and the stearic acid (part A) to be neutralized were placed in a glass vessel and heated to 140° F. with mixing. The 45 w/w % potassium hydroxide aqueous solution (part B) was warmed and then added to the stearic acid-nonionic surfactant mix. The resulting soap-nonionic surfactant/water mixture was heated to 180° F., and the remainder of the stearic acid (part D) was added. Once the mixture was homogeneous, water (part E) heated to 140° F. was added, and the formulation was mixed until clear.

Preparation of Conditioning Articles

Dryer sheets were prepared by applying the coating mixture to pre-weighed substrate sheets of about 6.75 inches×12 inches dimensions. The substrate sheets were comprised of about 4 denier spun-bonded polyester. The formulation was then coated onto the substrate using an in-house bench top laminator and coater manufactured by Talboys Engineering Corp., Pa. The sheet was weighed to determine the amount of coating mixture on the sheet. The target sheet weight was 1.5 grams. If the weight was in excess of the target weight, the sheet was passed through the coater to remelt the coating mixture and remove some of the excess. If the weight was under the target weight, the sheet was also passed through the coater and more coating mixture was added.

Dryer sheets having the following formulations were prepared as described above.

TABLE 1

| Sample | K-soap, % | Neodol 25-9, % | Water, % | Stearic Acid, % |
|---|---|---|---|---|
| 1 | 5 | 5 | 1 | 89 |
| 2 | 5 | 15 | 15 | 65 |
| 3 | 5 | 25 | 1 | 69 |
| 4 | 5 | 25 | 6 | 64 |
| 5 | 10 | 10 | 15 | 65 |
| 6 | 10 | 20 | 15 | 55 |
| 7 | 15 | 5 | 15 | 65 |
| 8 | 15 | 15 | 30 | 40 |
| 9 | 15 | 15 | 15 | 55 |
| 10 | 15 | 20 | 15 | 50 |
| 11 | 15 | 25 | 6 | 54 |
| 12 | 15 | 25 | 15 | 45 |
| 13 | 20 | 20 | 10 | 50 |
| 14 | 25 | 5 | 6 | 64 |
| 15 | 25 | 15 | 6 | 54 |
| 16 | 25 | 15 | 15 | 45 |
| 17 | 25 | 25 | 6 | 44 |
| 18 | 25 | 25 | 15 | 35 |
| 19 | 25 | 25 | 30 | 20 |
| 20 | 15 | 50 | 5 | 30 |

Samples 3–7, 9–18 and 20 are within the scope of the present invention. Samples 2, 8 and 19 could not be processed.

Example 2

To demonstrate the anti-static capabilities of the dryer sheets containing the compositions of the present invention, dryer sheets were evaluated using an in-situ static measurement methodology. In each test, the load was washed three times in a commercially available detergent in warm water. The load consisted of three 3'×3' pieces of each of the following fabrics: 100% orlon, 100% acrylic blanket, 100% double knit polyester jersey, 100% single knit polyester lining and 100% nylon. A liquid fabric softener was added to the final rinse cycle when desired. The test bundle was then transferred to a Lady Kenmore Heavy Duty dryer which had been previously treated to ensure removal of any prior added anti-static-softener. A pre-weighed dryer sheet was added to the load, and the test load plus dryer sheet (if used) was tumble dried for a 60 minute timed heat cycle, which was followed by a 10-minute cool down. An electrostatic field meter probe, manufactured by Monroe Electronics, NY, was previously mounted onto the inside door of the dryer. At the start of the drying cycle, an electrostatic field meter, also manufactured by Monroe Electronics, NY, was turned on, and the output was sent to a chart recorder. The electrostatic values at 0, 20, 40 and 70 minutes were recorded and tabulated to compare products.

The maximum absolute value possible for the electrostatic meter is 10. If a value is recorded as 10, then the real electrostatic field value most likely went off the scale of the meter and indicates a highly charged field. In general, if the 20 minute and the 40 minute values are less than 4 and the 70 minute value is less than 6, then the anti-static benefit of the product being tested is considered good. These values were determined from evaluations of commercial products and noting the temperature dependence of static measured in the dryer, i.e., electrostatic charges are generally lower under high heat conditions than at room temperature.

The electrostatic values of formulations outside the scope of the invention are as follows:

TABLE 2

| Sample | Formula Description | 0 | 20 min | 40 min | 70 min |
|---|---|---|---|---|---|
| 21 | no dryer sheet | 0 | 8.8 | 9.4 | 10 |
| 22 | 25% LAS/75% stearic acid | 0 | 7.2 | 6.6 | 10 |
| 23 | 15% potassium stearate/85% stearic acid | 0 | 10 | 4 | 9.2 |
| 24 | 10% Steareth-20 ($HLB^{15.3}$)/90% stearic acid | 0 | 7.4 | 7 | 6.8 |
| 25 | 40% Neodol 25-9($HLB^{13.1}$) /50% stearic acid/10% water | 0 | 6 | 6 | 2.8 |
| 26 | 100% Neodol 25-20 ($HLB\sim^{16}$) | 0 | 4.4 | 4.8 | 4.8 |
| 27 | 50% DHTDMAMS[1]/50% stearic acid | 0 | 1.7 | 0.8 | 5.2 |
| 28 | 70% DHTDMAMS[1]/30% stearic acid | 0 | 1.6 | 0.6 | 4.4 |
| 29 | 15% potassium stearate/15% Neodol 25-3 ($HLB^{7.8}$),4.5% water/55% stearic acid | 0 | 3.8 | 4.0 | 7.5 |

[1]Dihardened tallow dimethyl ammonium methyl sulfate

In comparison sample 9 of Example 1 within the invention exhibited the following electrostatic values.

| Sample | Formula Description | 0 | 20 min | 40 min | 70 min |
|---|---|---|---|---|---|
| 9 | 15% Potassium stearate/15% Neodol 25–9($^{13.1}$), 15% water, 55% Stearic acid | 0 | 0.8 | 1.6 | 5.0 |

As can be seen from the data, dryer sheets of the present invention show antistatic properties as good as or at least as comparable as dryer sheets containing typical cationic containing compositions applied to dryer sheets. The data also shows that compositions composed of anionic surfactants alone or nonionic surfactants alone, as taught in the prior art, do not provide adequate static prevention especially during the drying cycle. Nonionic surfactants with HLB's of less than 11, as in Sample 29, which are outside the scope of the present invention, also do not provide adequate static prevention especially at the end of the drying cycle.

Example 3

The proportions of the ingredients of the invention are essential in order to achieve effective anti-static benefit throughout the drying cycle as illustrated in Table 3 below:

In particular the composition will tolerate a maximum amount of water before the mixture becomes un-processable and minimum amounts of the nonionic and anionic components are required for anti-static effectiveness. To demonstrate the criticality of the proportions of the components of the invention the electrostatic values of 19 of the samples set out in Table 1 and prepared as described in Example 1 were measured and presented in Table 3 below:

TABLE 3

| Sample | K-soap | Neodol 25-9 | Water | Stearic Acid | 0 | 20 min | 40 min | 70 min |
|---|---|---|---|---|---|---|---|---|
| 1 | 5 | 5 | 1 | 89 | 0 | 8 | 8 | 10 |
| 2 | 5 | 15 | 15 | 65 | | not processed | | |
| 3 | 5 | 25 | 1 | 69 | 0 | 3.2 | 2 | 3.2 |
| 4 | 5 | 25 | 6 | 64 | 0 | 2 | 1.6 | 2 |
| 5 | 10 | 10 | 15 | 65 | 0 | 2.4 | 3.2 | 5.6 |
| 6 | 10 | 20 | 15 | 55 | 0 | 1.2 | 1.2 | 2.8 |
| 7 | 15 | 5 | 15 | 65 | 0 | 3.0 | 3.6 | 10 |
| 8 | 15 | 15 | 30 | 40 | | not processed | | |
| 9 | 15 | 15 | 15 | 55 | 0 | 0.8 | 1.6 | 5 |
| 10 | 15 | 20 | 15 | 50 | 0 | 0.8 | 0.8 | 3.6 |
| 11 | 15 | 25 | 6 | 54 | 0 | 1.0 | 0.8 | 2 |
| 12 | 15 | 25 | 15 | 45 | 0 | 1.0 | 1.2 | 2.8 |
| 13 | 20 | 20 | 10 | 50 | 0 | 2.0 | 1.2 | 3.2 |
| 14 | 25 | 5 | 6 | 64 | 0 | 2.8 | 1.2 | 1.2 |
| 15 | 25 | 15 | 6 | 54 | 0 | 2.8 | 0.8 | 4 |
| 16 | 25 | 15 | 15 | 45 | 0 | 2.0 | 1.8 | 2 |
| 17 | 25 | 25 | 6 | 44 | 0 | 1.8 | 1.6 | 2 |
| 18 | 25 | 25 | 15 | 35 | 0 | 4.0 | 1.6 | 1.8 |
| 19 | 25 | 25 | 30 | 20 | | not processed | | |
| 20 | 15 | 50 | 5 | 30 | 0 | 0.4 | 0.4 | 1.2 |

Only samples 3–7, 9–18 and 20 within the scope of the invention were both processable and effective antistatic compositions. Specifically all of these samples contain a total sum of anionic and water-soluble nonionic surfactants of greater than or equal to 20 wt. % and a ratio of water or water soluble materials to water-soluble nonionic surfactant of less than 2:1. The electrostatic values for these samples were less than 4, 4 and 6 for 20 minutes, 40 minutes and 70 minutes, respectively.

Samples 1–2, 8 and 19 were ineffective as antistatic compositions or exhibit difficulties in processing and are outside the scope of the invention. In particular, Example 1 contained only 10% anionic and nonionic amounts which are insufficient to provide a total of antistatic efficacy. The water to anionic surfactant, potassium stearate, ratio is 3 to 1 for sample 2, which caused phase separation. As demonstrated in samples 8 and 19, having water contents in the formulations of equal or higher than 30 wt. % exhibited a high viscosity and were too thick to process and coat.

Example 4

Sample 9 described in Example 1 was prepared and compared for fabric softening performance against two commercially available dryer sheets.

For each product, a bundle of cloths consisting of 4 terry cloth towels and enough 100% cotton sheeting to equal a six pound load was washed in hot water with a commercially available detergent. The test bundles were then transferred to a dryer and a pre-weighed dryer sheet was added. The test bundle and dryer sheet were dried for sixty minutes. This test was repeated for each product.

Fabric softening was evaluated in a paired comparison of the commercial product to the composition of the present invention. Five panelists felt each of the eight pairs of terry towels and judged which one was softer or chose no preference. The towel judged to be softer was assigned a "1"; the other was assigned a "2". No preference choices were assigned a "1.5". These values were averaged, and a computerized analysis of variance programs summarized the results as follows:

TABLE 5

| | | | |
|---|---|---|---|
| Sample 9 | 1.32 | Sample 9 | 1.46 |
| Commercial Product (A)[1] | 1.68 | Commercial Product (B)[2] | 1.54 |
| LSD | 0.22 | LSD | 0.26 |

[1]50 wt. % DHTDMAMS and 50 wt. % stearic acid
[2]44 wt. % stearyl dimethyl amine stearate, 27.7 wt. % sorbitan monostearate, 21.3 wt. % DHTDMAMS and 8% sodium montmorillonite clay.

The LSD (Least Significant Difference) values indicated the difference in score units needed for statistical significance. The table shows that the article of the present invention provides statistically superior softening to Commercial Product (A), and directionally superior equivalent softening to Commercial Product (B) dryer sheets.

Example 5

The following formulations were prepared to assess the tactile properties of dryer sheets prepared according to the invention.

| Sample | Formula Description | Tactile Properties |
|---|---|---|
| 29 | Commercial Product A[1] | waxy |
| 30 | Commercial Product B[2] | waxy |
| 31 | 100% Neodol 25-20 | greasy, oily |
| 9[3] | 15 K-soap/15 Neodol 25-9/15 water/55 stearic | dry, smooth |

[1]50 wt. % DHTDMAMS and 50 wt. % stearic acid
[2]Commercial Product B from Example 4
[3]Sample 9 from Example 1

The tactile properties of the dryer sheet according to the invention were improved over those of both commercial products and dryer sheets containing only a nonionic surfacant. This is not a surprising result, as there is the characteristic tactile feel of cationic dryer sheet compositions.

Example 6

Additional compositions within the scope of the invention were prepared and their electrostatic values determined as described in Example 1 with the following results as indicated in Table 6.

TABLE 6

| Sample | Formula Description | 0 | 20 min | 40 min | 70 min |
|---|---|---|---|---|---|
| 32 | 19 Na-soap/19 Neodol 25-9/11 water/61 stearic acid | 0 | 1.2 | 2.0 | 2.0 |
| 33 | 18 K-soap/8 Steareth-20/24 water/50 stearic acid | 0 | 0.4 | 0.7 | 5.0 |
| 34 | 15 K-soap/15 Neodol 25-9/15 water/55 Stearyl Alcohol | 0 | 0.8 | 0.8 | 1.6 |
| 35 | 15 K-soap/15 Neodol 25-9/15 Glycerin/55 stearic acid | 0 | 0.8 | 1.2 | 2.0 |
| 36 | 15 K-soap/15 Neodol 25-9/15 Propylene Glycol/55 stearic acid | 0 | 1.4 | 1.4 | 3.2 |

TABLE 6-continued

| Sample | Formula Description | 0 | 20 min | 40 min | 70 min |
|---|---|---|---|---|---|
| 37 | 14.8 sodium fatty alcohol ethoxysulfate/15 Neodol 25-9/4.9 water/60 stearic acid/3.7 propylene glycol/ethanol 1.6 | 0 | 1.0 | 2.8 | 4.4 |
| 38 | 15 K-soap/40 Alfonic 1412-60/4 water/41 stearic acid | 0 | 0.4 | 0.2 | 2.0 |
| 39 | 15 K-soap/50 Neodol 45-13/4 water/31 stearic acid | 0 | 0.8 | 0.8 | 2.2 |
| 40 | 15 K-soap/50 Neodol 25-12/4 water/31 stearic acid | 0 | 0.4 | 2.0 | 4.0 |
| 41 | 0 release aid | | | | |
| 42 | 35 K-soap/55 BNF/10 water/no release aid | 0 | 2.8 | 1.2 | 1.2 |

What is claimed is:

1. A tumble dryer article having an anti-static benefit comprising:

1) a fabric conditioning composition comprising:

a) 3% to 80% wt. % of a water-soluble nonionic surfactant, selected from the group consisting of ethoxylated fatty alcohols with from about 8 to about 22 carbon atoms with an EO range of from 7 to 15 and an HLB of >12;

b) 3% to 50 wt. % of an anionic surfactant selected from the group consisting of water soluble salts of fatty acids, alkyl and alkylbenzene sulfates and sulfonates, alkyl glycerol ether sulfonates, ethoxylated alkyl sulfonates, ethoxylated alkyl sulfates and mixtures thereof;

c) 25% to 80 wt. % of a non-surfactant release aid that is lipophilic and solid at room temperature selected from the group consisting of fatty acids having from about 8 to about 22 carbon atoms, fatty alcohols having from about 8 to about 22 carbon atoms, natural waxes, synthetic waxes, and mixtures thereof;

(d) 0% to 25 wt. % of an aqueous ingredient selected from the group consisting of water and polyhydric alcohols and mixtures thereof; and 2) means for dispensing the fabric conditioning composition onto fabrics in a tumble dryer, provided that the total sum of a+b is greater than or equal to 20 wt. %, the ratio of d:b is less than 2:1 and substantially no cationic actives are present in the composition.

2. An article according to claim 1, wherein the water-soluble nonionic surfactant is an ethoxylated fatty alcohol with an HLB of >12 to 20.

3. An article according to claim 2, wherein the water-soluble nonionic surfactant is an ethoxylated fatty alcohol with an HLB of >12 to 17.

4. An article according to claim 1, wherein the ethoxylated fatty alcohol is present in an amount of 10 wt. % to 70 wt.

5. An article according to claim 1, wherein the anionic surfactant is present in an amount of 4 wt. % to 35 wt. %.

6. An article according to claim 1, wherein the non-surfactant release aid is present in an amount of 25 wt. % to 75 wt. %.

7. An article according to claim 1, wherein the polyhydric alcohol is propylene glycol or glycerin.

8. An article according to claim 1, wherein the composition further comprises one or more optional additives selected from the group consisting of perfumes, dyes, pigments, enzymes, dye transfer inhibiting agents, opacifiers, germicides, optical brighteners, corrosion agents, preservatives, antioxidants, colorants, bacteriocides, soil release polymers, skin care benefit agents, perfume carriers and mixtures thereof, the amount of each additive being up to about 10 wt. %.

9. A method of reducing the amount of static in a tumble dried article of laundry comprising:

1) preparing a fabric conditioning composition comprising:

a) 3% to 80% wt. % of a water-soluble nonionic surfactant, selected from the group consisting of ethoxylated fatty alcohols with from about 8 to about 22 carbon atoms with an EO range of from 7 to 15 and an HLB of >12;

b) 3% to 50 wt. % of an anionic surfactant selected from the group consisting of water soluble salts of fatty acids, alkyl and alkylbenzene sulfates and sulfonates, alkyl glycerol ether sulfonates, ethoxylated alkyl sulfonates, ethoxylated alkyl sulfates and mixtures thereof;

c) 25% to 80 wt. % of a non-surfactant release aid that is lipophilic and solid at room temperature selected from the group consisting of fatty acids having from about 8 to about 22 carbon atoms, fatty alcohols having from about 8 to about 22 carbon atoms, natural waxes, synthetic waxes, and mixtures thereof; and d) 0% to 25 wt. % of an aqueous ingredient selected from the group consisting of water and polyhydric alcohols and mixtures thereof;

with the proviso that the total sum of a+b is greater than or equal to 20 wt. %, the ratio of d:b is less than 2:1; and 2) contacting an article of clothing with the fabric conditioning composition, wherein such contact provides an anti-static benefit with substantially no cationic actives present in the composition.

* * * * *